US011608237B2

(12) United States Patent
McCarthy et al.

(10) Patent No.: US 11,608,237 B2
(45) Date of Patent: Mar. 21, 2023

(54) SYSTEM AND METHOD FOR AUTOMATED SHEET ADJUSTMENT

(71) Applicant: Xerox Corporation, Norwalk, CT (US)

(72) Inventors: Jacob R. McCarthy, Williamson, NY (US); Joseph M. Ferrara, Jr., Webster, NY (US); Joseph Fredrick Casey, Webster, NY (US); Christopher Douglas Atwood, Rochester, NY (US); Frank B. Tamarez Gomez, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 151 days.

(21) Appl. No.: 17/209,437

(22) Filed: Mar. 23, 2021

(65) Prior Publication Data

US 2022/0308516 A1 Sep. 29, 2022

(51) Int. Cl.

| | |
|---|---|
| ***B65H 7/10*** | (2006.01) |
| ***G03G 15/00*** | (2006.01) |
| ***B41J 13/32*** | (2006.01) |
| ***B65H 9/00*** | (2006.01) |
| ***B65H 7/14*** | (2006.01) |
| ***B65H 85/00*** | (2006.01) |

(52) U.S. Cl.

CPC ..... *B65H 7/10* (2013.01); *B41J 13/32* (2013.01); *B65H 7/14* (2013.01); *B65H 9/002* (2013.01); *B65H 85/00* (2013.01); *G03G 15/5029* (2013.01); *G03G 15/6567* (2013.01); *B65H 2403/52* (2013.01); *B65H 2553/42* (2013.01); *B65H 2553/45* (2013.01)

(58) Field of Classification Search

CPC ... B65H 7/10; B65H 7/14; B65H 7/20; B65H 9/10; B65H 9/103; B65H 85/00; B65H 2403/52; B65H 2553/42; B65H 2553/45; G03G 15/6567

See application file for complete search history.

(56) References Cited

U.S. PATENT DOCUMENTS

| | | | | |
|---|---|---|---|---|
| 4,179,117 | A | 12/1979 | Rhodes, Jr. | |
| 5,065,998 | A | 11/1991 | Salomon | |
| 6,137,989 | A * | 10/2000 | Quesnel | G03G 15/6564 399/394 |
| 10,569,981 | B2 | 2/2020 | Sawicki | |
| 10,589,950 | B2 | 3/2020 | Irizarry | |
| 2014/0312561 | A1 * | 10/2014 | Park | B65H 5/06 271/227 |

(Continued)

OTHER PUBLICATIONS

U.S. Appl. No. 16/988,183, filed Aug. 7, 2020, Taylor.

*Primary Examiner* — Prasad V Gokhale
(74) *Attorney, Agent, or Firm* — Lippes Mathias LLP

(57) ABSTRACT

A sheet processing system for automated sheet adjustment includes a sensor system which captures at least a first image of a sheet of print media as the sheet is conveyed on a main transport path between a print media supply module and a marking device of an image rendering module. A control module computes a lateral error for the sheet, based on the captured at least first image, and computes an adjustment based on the computed lateral error. A sheet transport path adjustment mechanism translates a first portion of the main transport path relative to a second portion of the main transport path, based on the computed adjustment.

17 Claims, 14 Drawing Sheets

(56) References Cited

U.S. PATENT DOCUMENTS

| | | | | |
|---|---|---|---|---|
| 2015/0284203 | A1 | 10/2015 | Terrero | |
| 2018/0057302 | A1* | 3/2018 | Yokawa | G07D 11/17 |
| 2019/0283999 | A1* | 9/2019 | Herrmann | B65H 9/002 |
| 2019/0300314 | A1 | 10/2019 | Irizarry | |
| 2019/0308832 | A1* | 10/2019 | Warner | B65H 7/10 |

* cited by examiner

SYSTEM AND METHOD FOR AUTOMATED SHEET ADJUSTMENT

BACKGROUND

Aspects of the exemplary embodiment relate to image on paper registration and find particular application in connection with a system and method for adjusting a sheet transport path for alignment of sheets to be printed.

During initial set up of imaging devices, such as printers, adjustments may be performed to ensure various parts of a sheet transport path are aligned in such a way that sheets of print media are suitably positioned when they enter a marking device for printing. Particularly in the case of duplex printing, the setup procedures are often cumbersome and time consuming. For the first side to be printed, the adjustments may entail undocking and redocking of a print media supply module several times after checking the input lateral position of the sheet. For the second side to be printed, the adjustments may entail manually skewing horizontal transports of a duplex path. This is also an iterative process, involving adjusting the transports until the desired input values are reached.

Additionally, over time, the initial adjustments may no longer be applicable, for example, if modifications are made to the imaging device, such as to the print speed, or if the sheet size being used differs from that specified.

There remains a need for an automated system and method for adjusting a transport path for improved sheet alignment.

INCORPORATION BY REFERENCE

The following references, the disclosures of which are incorporated in their entireties by reference, are mentioned:

U.S. Pat. No. 10,589,950, issued Mar. 17, 2020, entitled GRAVITY-ASSISTED WALL REGISTRATION SYSTEM, by Irizarry, et al., describes a gravity-assisted wall registration system. A transport member includes an angled surface on which an associated sheet is translated in a process direction. The sheets are pushed towards a wall positioned along a lower edge of the surface.

U.S. Pub. No. 20150284203, published Oct. 8, 2015, entitled FINISHER REGISTRATION SYSTEM USING OMNIDIRECTIONAL SCUFFER WHEELS, by Terrero, et al., describes a sheet registration system for use in a finisher of a digital printing system. Omnidirectional scuffer wheels with a plurality of overlapping rollers provide uninterrupted traction to move media sheets against a registration wall for process direction registration.

U.S. Pat. No. 5,065,998, issued Nov. 19, 1991, entitled LATERAL SHEET REGISTRATION SYSTEM, by Salomon, describes a sheet registration and feeding system for laterally registering a sheet without frictional drive slippage against the sheet.

U.S. Pat. No. 4,179,117, issued Dec. 18, 1979, entitled PAPER ALIGNMENT ROLLERS, by Rhodes, Jr., describes paper aligning rolls in which the drive roll is skewed to the direction of travel to move paper toward a referencing edge while a backup roll is oppositely skewed to urge the paper away from the referencing edge.

U.S. application Ser. No. 16/988,183, filed Aug. 7, 2020, entitled SYSTEM AND METHOD FOR MEASURING IMAGE ON PAPER REGISTRATION USING CUSTOMER SOURCE IMAGES, by Taylor, et al., describes a method for registering source and target images. A scanned image is generated by scanning a printed version of a source image, which includes a target image. A first transform is computed to align corners of the target with corners of the source image. Local features in the source image and aligned target image are detected and a second transform is computed to align the target image with the first source image, based on the detected local features.

BRIEF DESCRIPTION

In accordance with one aspect of the exemplary embodiment, a sheet processing system for automated sheet adjustment includes a sensor system which captures at least a first image of a sheet of print media as the sheet is conveyed on a main transport path between a print media supply module and a marking device of an image rendering module. A control module computes a lateral error for the sheet, based on the captured at least first image, and computes an adjustment based on the computed lateral error. A sheet transport path adjustment mechanism translates a first portion of the main transport path relative to a second portion of the main transport path, based on the computed adjustment.

In accordance with another aspect of the exemplary embodiment, a sheet processing method includes receiving a captured first image of a sheet of print media as the sheet is conveyed on a main transport path between a print media supply module and a marking device of an image rendering module; computing a lateral error for the sheet, based on the captured first image; computing an adjustment based on the computed lateral error when the lateral error exceeds a threshold; and providing instructions for translating a first portion of the main transport path relative to a second portion of the main transport path, with a first automated adjustment component, based on the computed adjustment.

In accordance with another aspect of the exemplary embodiment, a sheet adjustment system includes memory which stores instructions for receiving at least a first image of a sheet of print media captured as the sheet is conveyed on a main transport path between a print media supply module and a marking device of an associated image rendering module, computing a lateral error for the sheet, based on the captured at least first image, determining whether the lateral error exceeds a threshold, computing an adjustment based on the computed lateral error when the lateral error exceeds the threshold, and providing the computed adjustment to an associated sheet transport path adjustment mechanism configured for automatically translating a first portion of the main transport path relative to a second portion of the main transport path, based on the computed adjustment. A processor executes the instructions.

DETAILED DESCRIPTION

Figure 1:
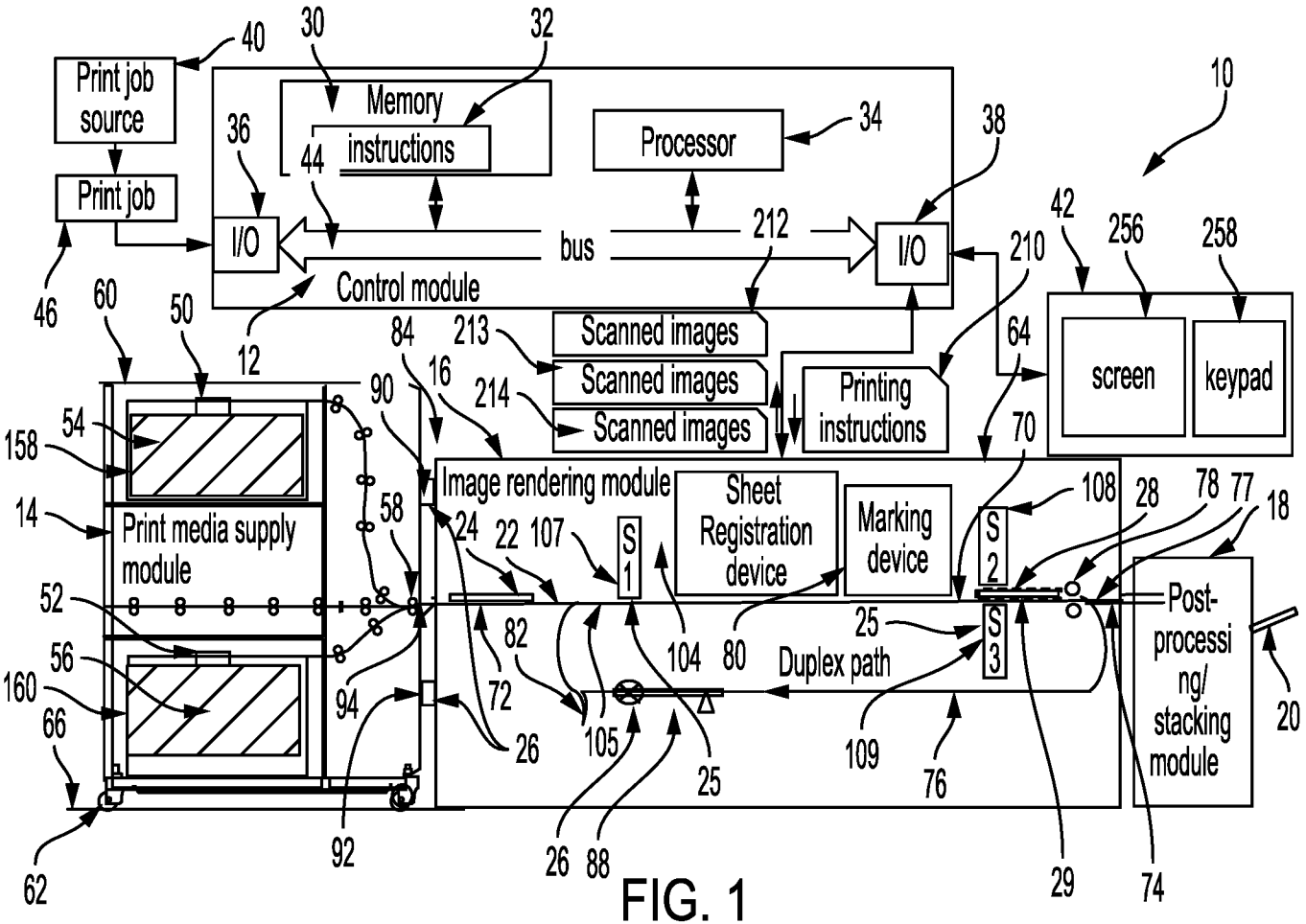
FIG. 1 is a functional diagram of a sheet processing system in accordance with one aspect of the exemplary embodiment.

With reference to FIG. 1, a sheet processing system 10 includes a control module 12 and a sequence of sheet processing modules, such as a print media supply module 14, an image rendering module 16, optionally one or more post-processing modules 18, and an output module 20. Each module defines a portion of a sheet transport path 22, on which sheets 24 to be printed are conveyed in a downstream direction, between the supply module 14 and the output module 20. A sensor system 25 detects the position of sheets 24 at one or more locations on the transport path 22 and provides information to the control module 12. A sheet transport path adjustment mechanism 26 enables portions of the transport path 22 to be translated, relative to one another, for improved alignment of the sheets 24 on the transport path and registration of an image 28 (or side 1 and side 2 images 28, 29) on each sheet.

The control module 12 may be entirely separate from the sheet processing modules 14, 16, 18, 20, while being communicatively connected with them, or may be at least partially distributed over one or more of the sheet processing modules. The illustrated control module 12 includes memory 30 which stores instructions 32 for performing at least a part of the exemplary method and a processor 34, in communication with the memory, for executing the instructions. One or more input/output devices 36, 38 enable the control module 12 to communicate with external devices, such as the sheet processing modules 14, 16, 18, 20, a print job source 40, and, optionally, a user interface 42. Hardware components 30, 34, 36, 38 of the control module 12 may be communicatively connected by a data/control bus 44. The control module 12 receives print jobs 46 from the source 40, and causes them to be rendered on sheets of print media and output by the processing modules 14, 16, 18, 20.

The illustrated print media supply module 14 includes one or more sheet feeders 50, 52 which are configured to feed sheets 24 singly from stacks 54, 56, on to a common, first portion 58 of the sheet transport path 22. The sheet feeders 50, 52, stacks 54, 56, and portion 58 of the sheet transport path 22 are mounted on a first frame (or housing) 60, which may be supported on rolling members 62, such as wheels or other devices for moving the supply module 14 across the floor 66, from a position remote from the image rendering module 16 to a position proximate a second frame (or housing) 64 of the image rendering module 16.

The illustrated image rendering module 16 includes a second portion 70 of the transport path 22, which extends from an inlet end 72, closest to the first housing 60, to an outlet end 74, upstream of the postprocessing module 18/output module 20. The second portion 70 of the transport path 22 (which referred to herein as a main transport path) may feed printed sheets to a duplex transport path 76, via a duplex path inlet slot 77, when duplex printing is to be performed.

The sheets are transported along the transport path 22 by a sheet transport mechanism 78, which may include one or more conveying members, such as rollers, belts, air jets, and the like for conveying the sheets 24 along the transport path 22.

Positioned along the main transport path 22 are one or more marking devices 80, which apply images to first sides the sheets with a marking material, such as inks or toners, and fix the marking material to the sheet using heat, pressure, radiation, combination thereof, or the like. For duplex printing, the printed sheet may be returned to the same marking device 80 via the duplex path 76. A first end of the duplex transport path 76 is connected to the main transport path 70 downstream of the marking device 80 and a second end of the duplex transport path is connected to the main transport path upstream of the marking device.

An inverter 82 in the path 76 inverts the sheet so that it is printed on the opposite (second) side when it returns to the marking device 80. In other embodiments, rather than returning the sheets to the (first) marking device 80, the sheet 24 is inverted and transported to a second marking device (not shown) for printing the second side.

The sheet transport path adjustment mechanism 26 may include one or more adjustment components 84, 86, 88 which mechanically move one portion of the transport path, relative to another, thereby shifting sheets laterally (i.e., in the cross-process direction) on the transport path. A first adjustment component 84, which shifts sheets laterally (i.e., in the cross-process direction) by moving one portion of the transport path relative to another, upstream of the marking device 80. In the embodiment illustrated in FIG. 1, the first adjustment component 84 enables one or both of the first and second path portions 58, 70 to be moved laterally, relative to the other. The first adjustment component includes one or more brackets 90, 92, which are fixed to the housing 60 of the print media supply module 14, and slidably linked to the housing 64, allowing the module to be shifted (e.g., laterally), relative to the housing 64 of the image rendering module 16. As a result, an output end 94 of the first path portion 58 moves relative to the input end 72 of the second path portion 70. Sheets 24 travelling from the first portion 58 of the transport path to the second portion 72 of the transport path 22 are thus shifted to a different lateral position on the second portion 72.

Figure 2:
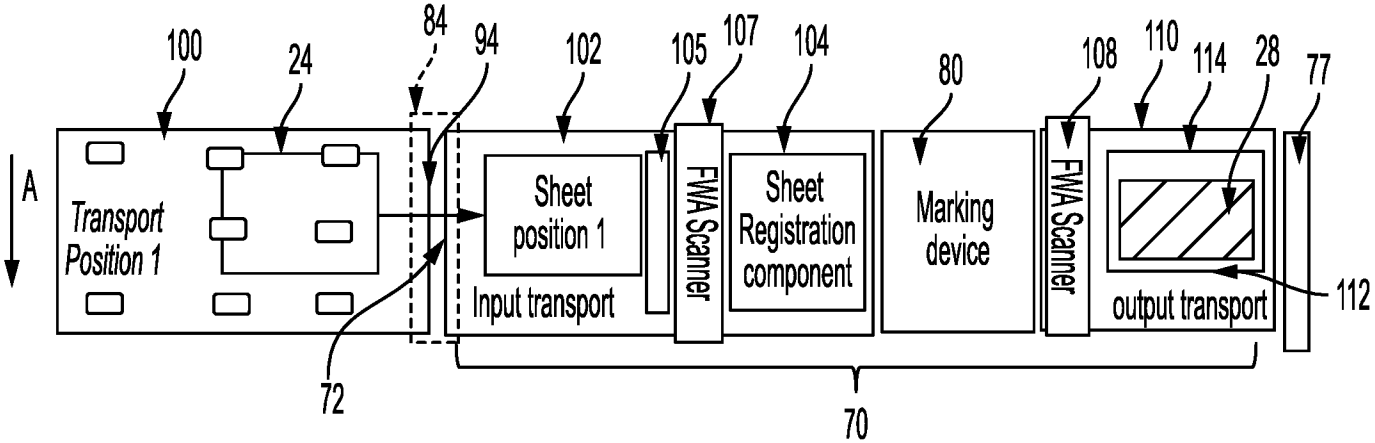
FIG. 2 is a top plan view of a transport path of the sheet processing system of FIG. 1.
Figure 3:
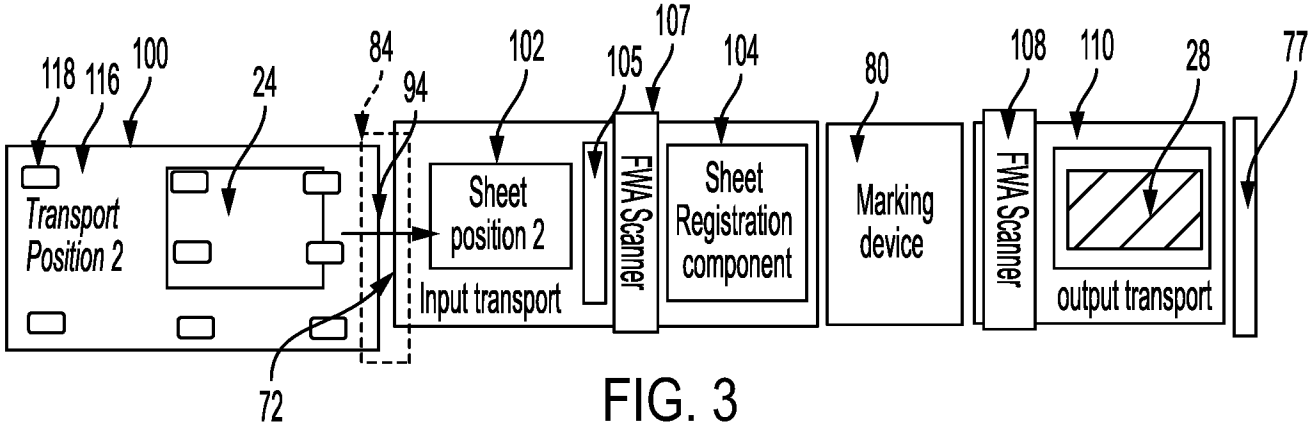
FIG. 3 is a top plan view of the main transport path of FIG. 2, after translation of a first portion of the transport path relative to a second portion of the transport path.

With reference to FIGS. 2 and 3, the lateral shifting of the sheet is illustrated in a top plan view of the paper path 70. The unmarked sheet 24 leaves the print media supply module 14 on a first transport member 100, which in FIG. 2 is shown in a first position (transport position 1). The unmarked sheet 24 enters the image rendering module 16 on an input transport member 102, upstream of the marking device 80 at a lateral (cross-process) position indicated by sheet position 1. When the first transport member 100 is moved to a second position (transport position 2), as shown in FIG. 3, the unmarked sheet 24 enters the image rendering module 16 on the input transport member 102 at a location (sheet position 2) which is laterally spaced from sheet position 1. The extent and direction (inboard/outboard) of the relative shift of the transport members 100, 102 affects the final position of the sheet 24 as it enters the marking device 80.

As will be appreciated, the first adjustment component 84 may perform only a part of the registration of the sheet in this way. In one embodiment, a sheet registration device 104, upstream of the marking device 80, provides further (e.g., more fine-grained) registration of the sheet 24. Rather than adjusting the relative positions of two transport members 100, 102, the sheet registration device 104 adjusts the position of the sheet relative to the transport member 102 (or a transport member downstream thereof) to correct image on paper registration errors. The sheet registration device 104 also provides for registration of sheets returned along the duplex path, which enter the main path 22 via an inlet slot 105, upstream of the sheet registration device 104.

Figure 9:
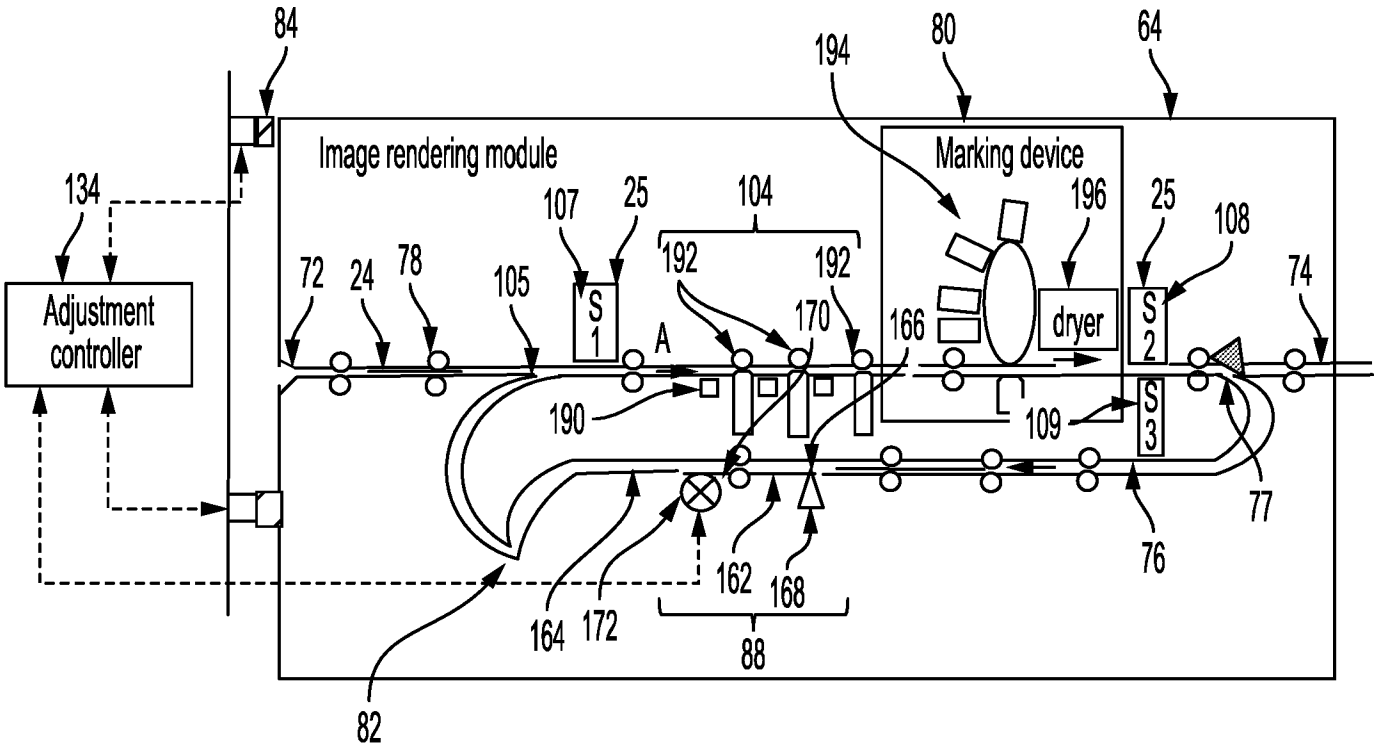
FIG. 9 is a functional diagram of the image rendering module of the sheet processing system of FIG. 1.

As illustrated in FIGS. 1 and 9, sensor system 25 may include one or more imaging devices, such as scanners 107, 108, 109 for capturing images of the paper path 22, with sheets 24 thereon. A first scanner 107, such as a full width array (FWA) scanner, may be positioned above the second portion 70 of the paper path 22, upstream of the sheet registration device 104 and marking device 80, e.g., downstream of the return path inlet slot 105. Data from the first scanner 107 may be used to determine the lateral position of the sheet 24 on the second portion 70 of the paper path as it enters the marking device 80. This information can be used to provide feedback to the sheet transport path adjustment mechanism 26. For example, if an error in lateral position of the sheet is identified, which exceeds a threshold, the sheet transport path adjustment mechanism 26 may make an adjustment to one or more portions of the paper path 22 which is intended to reduce the error in the lateral position of the sheets. Information on whether the sheet is arriving at scanner 107 from the feeder 50, 52 or from the return loop 76 can be used to determine where, in the paper path, the adjustments should be made to reduce the error for subsequent sheets. The scanner 107 may capture a scan of all or a part of a sheet 24 with a sufficient portion of the width of the transport 102 to allow the lateral shift (lateral error) of the sheet 24 to be computed. The scan(s) may also be used to compute skew (e.g., by determining a difference in lateral shift between a leading end of the sheet and a trailing end of the sheet). This information can be used to provide feedback to the sheet transport path adjustment mechanism 26 and/or the sheet registration device 104. For example, if a sheet arriving from the feeder with side 1 uppermost is not correctly positioned laterally, relative to the transport 102, the feedback may include instructing the first and/or second adjustment component 84, 86 to compensate for the error. Similarly, if a sheet arriving from the duplex path with side 2 uppermost is not correctly positioned laterally, relative to the transport 102, the feedback may include instructing the third adjustment component 88 to compensate for the error.

A second scanner 108, such as a full width array (FWA) scanner, which may be analogous to scanner 107, may be positioned downstream of the marking device 80, e.g., above a downstream transport 110. Information, such as captured images, from the second scanner 108 can used to determine the lateral position of the sheet 24 on the transport path 110 and/or the position of the image 28 on the printed sheet 24. This information can be used to provide feedback to the sheet transport path adjustment mechanism 26 and/or the sheet registration device 104. For example, if the image 28 is not correctly positioned, relative to the inboard and outboard edges 112, 114 of the sheet 24 (the image 28 is closer to the inboard edge in the illustration shown in FIG. 2), the feedback may include instructing the first or second adjustment component 84,86 to compensate for the error. If the sheet is not correctly positioned laterally, relative to the transport 110, the feedback may include instructing the one or more of the first, second, and third adjustment components 84, 86, 88 to compensate for the error.

A third scanner 109, such as a full width array (FWA) scanner, which may be analogous to scanners 107, 108 may be positioned downstream of the marking device, e.g., below the downstream transport 110, and below the second scanner 108. The scanner 109 is positioned to capture an opposite side of a sheet to the second scanner 108. Information, such as captured images, from the third scanner 109 can used to determine the position of the image 29 on the printed sheet 24. In the case of duplex printing, where the sheet has been inverted and the second side has been printed, image 29 is on the first side of the sheet to be printed. This information can be used to provide feedback to the sheet transport path adjustment mechanism 26 and/or the sheet registration device 104. For example, if the image 29 is not correctly positioned, relative to the inboard and outboard edges 112, 114 of the sheet 24, feedback may include instructing the first adjustment component 84 to compensate by moving the transport 100 relative to transport 102 in the direction of arrow A.

Alternatively, or additionally, information from the second and third scanners 108, 109 may be compared to evaluate alignment of the first and second images 28, 29, after both images have been printed and dried. Since the first side image 29 goes through the drier twice, it may undergo more shrinkage than the second side image 28. In this case, feedback may include transforming one or both images to be printed on opposite sides of the sheet such that they are more closely aligned in size and position.

Figure 4:
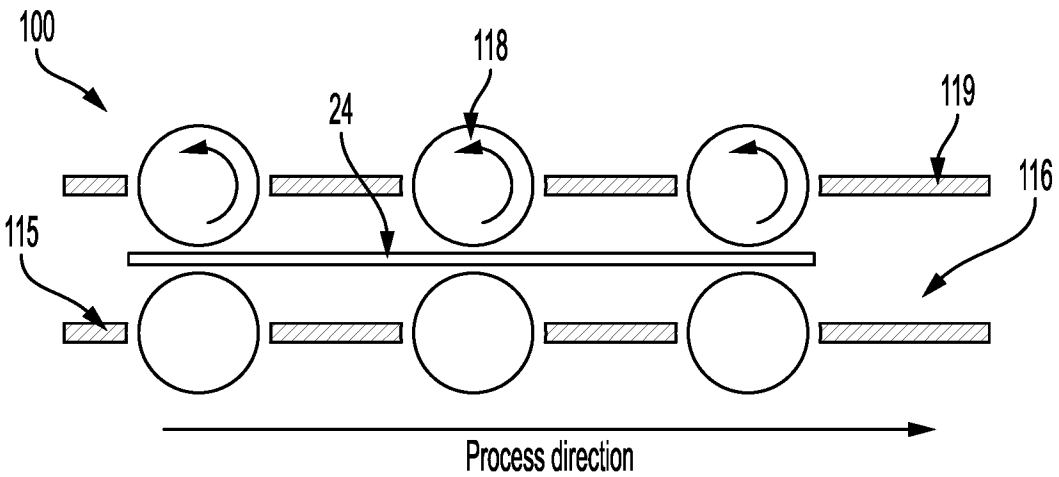
FIG. 4 is a side sectional view of a transport member of the system of FIG. 1.

As shown in FIG. 4, the transports 100, 102, 110 may each include a lower planar support 115, such as a plate, with an upper surface 116, on which the sheets travel. Each transport may further include one or more sheet conveying members 118, such as rollers, wheels, belts, air jets, or the like. The conveying members 118 cause the sheets to move in a downstream direction on the surface 116 of the planar support, which remains stationary during sheet transport (i.e., neither moves in a process direction nor a cross process direction relative to the housing 64). In the illustrated embodiment, the conveying members 118 are arranged in pairs to define a nip therebetween, through which the sheet 24 is transported. In each pair of conveying members, a first of the conveying members 118 may be driven by a motor, while the second is driven by the first of the conveying members. The transports 100, 102, 110 may further include an upper planar support 119, such as a plate, to constrain the sheet to a narrow gap.

In another embodiment, the transports 100, 102, 110 may each include a conveyor belt which conveys the sheets. In this embodiment, an upper surface of the conveyor belt moves in a process direction, but does not move in a cross process direction, during sheet transport.

Figure 6:
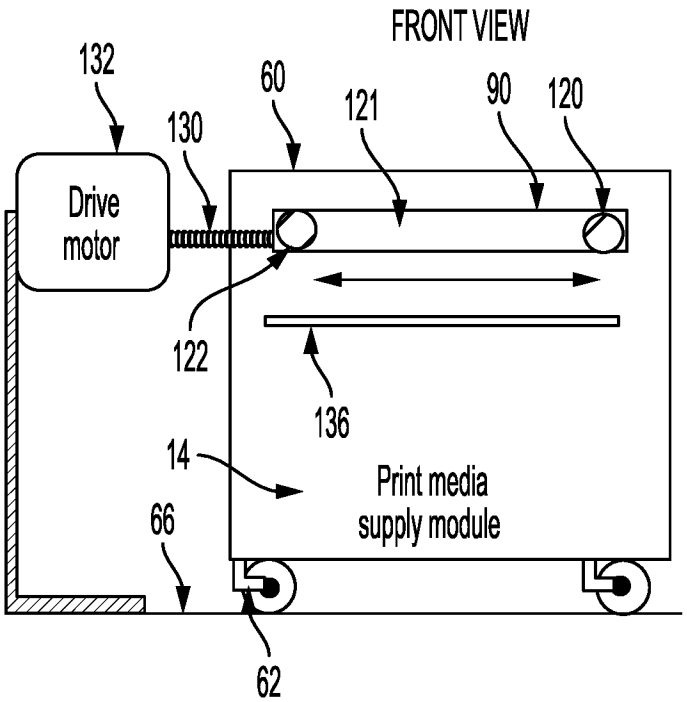
FIG. 6 is a front view of the first adjustment component and print media supply module of the system of FIG. 5.
Figure 5:
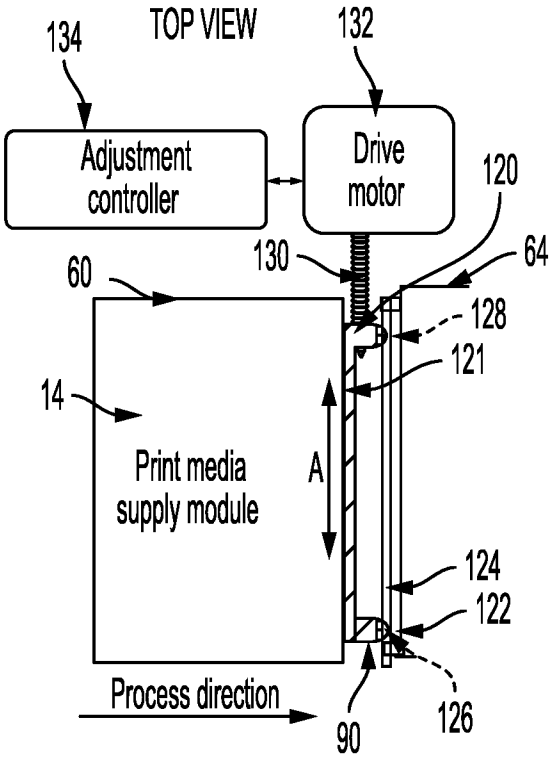
FIG. 5 is a top plan view of a first adjustment component of the system of FIG. 1, linking a print media supply module to a housing of an image processing module.

As illustrated in FIGS. 5 and 6, in one embodiment, the first adjustment component 84 includes one or more laterally adjustable docking brackets 90, 92. Each bracket 90, 92 includes an attachment portion 121, which is rigidly attached to one of the housings 60, 64 (e.g., housing 60) by fixing members such as bolts or screws. The bracket 90, 92 is movably attached to the other housing (e.g., housing 64) e.g., by means of flanges 120, 122, which extend perpendicularly from the attachment portion 121. The flanges 120, 122 may slide along a bar 124, which is rigidly attached to the housing 64. For example, the flanges 120, 122 may each include a bore 126, 128, or an open slot which receives the bar 124 therethrough.

The bracket 90, 92 is moveable, relative to housing 64 (IB to OB) by a lead screw 130 or similar mechanism, which may be driven by a reversible drive motor 132 that is rigidly mounted to the floor or other support structure. The lead screw may be carried in a correspondingly threaded laterally extending bore in the attachment portion 121. The drive motor 132 is automatically actuated by an adjustment controller 134, which may be a part of the control module 12 or may be a separate component. As a result of rotation of the lead screw 130 and the corresponding movement of the bracket 90, 92, the housing 60 is moved, relative to housing 64 and sheets exiting the housing 60 through a slot 136 enter the housing 64 at a new lateral position on the path 70. As noted with respect to FIG. 1, the housing 60 is supported on rolling members 62, such as rollers or wheels, such as pivotable wheels (e.g., on casters), which allow the housing 60 to be pushed or pulled, across the floor 66 to a new position, by the first adjustment component 84, while the housing 64 remains in the same fixed position.

Figure 7:
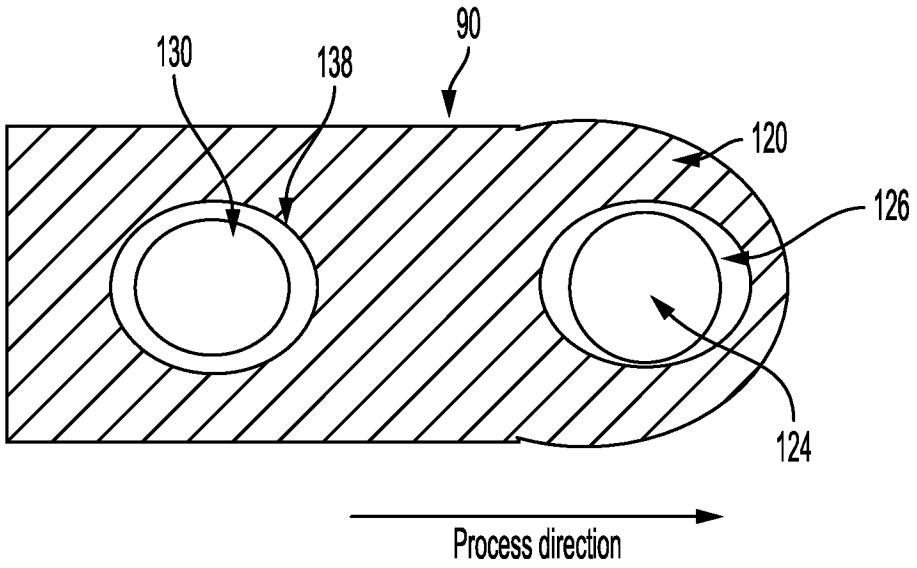
FIG. 7 is a side sectional view of the bracket of FIGS. 5 and 6.

FIG. 7 is an enlarged side sectional view of the bracket 90, showing the flange 120, a smooth bore 126 carrying the bar 124, and a threaded bore 138 receiving the threaded lead screw 130 in accordance with one example embodiment. As will be appreciated, bore 126 could be replaced with a downward opening socket which fits smoothly over the bar 124.

The number of flanges 120, 122 on each bracket 90, 92 is not limited to two. For example, there may be one, two, three or more flanges.

In another embodiment, the flanges 120, 122 may be attached directly to the housing 60, rather than indirectly, via the attachment portion 121.

Figure 8:
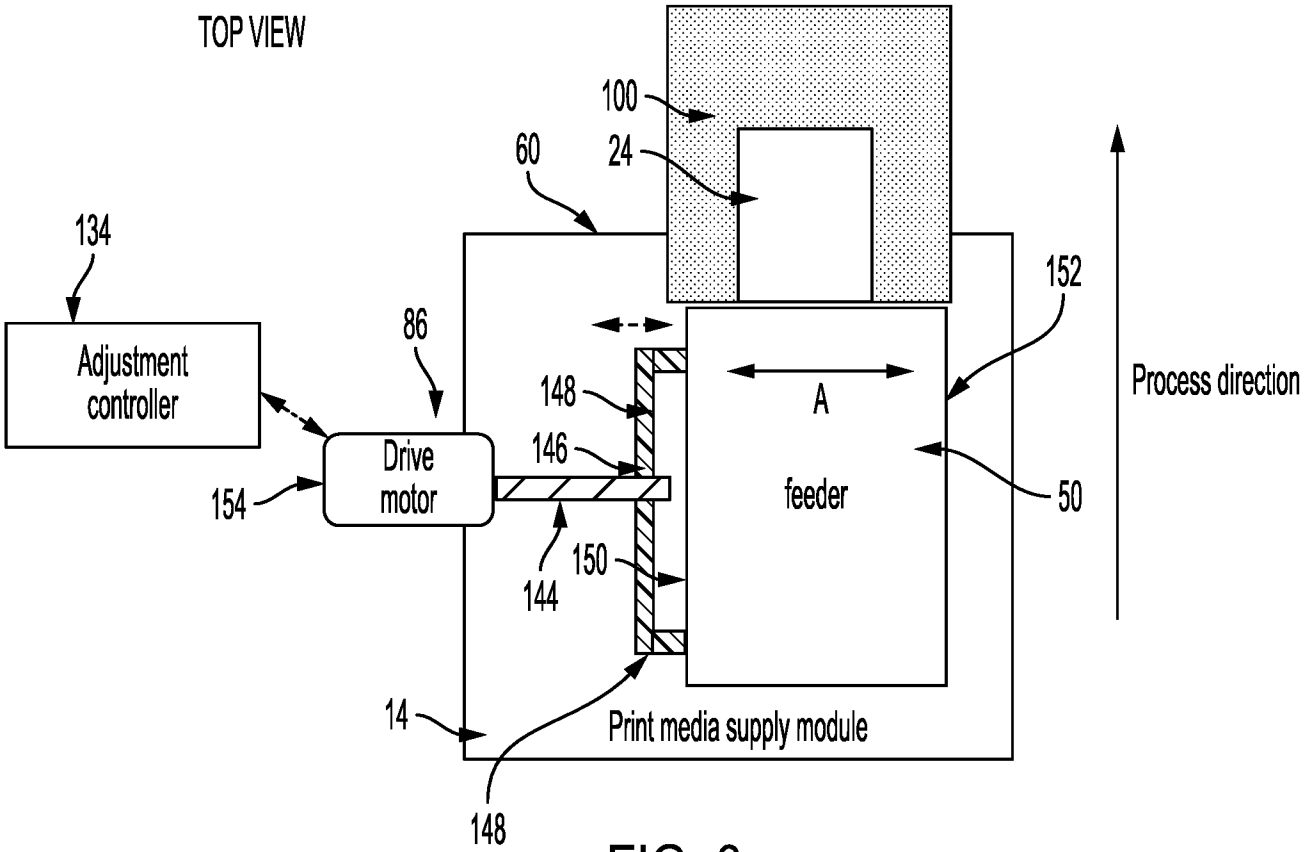
FIG. 8 is a top plan view of a second adjustment component and print media supply module of the system of FIG. 1.

As shown in FIG. 8 in top plan view, the sheet transport path adjustment mechanism 26 may alternatively or additionally include a second adjustment component 86, which is configured to move one portion of the transport path relative to another, upstream of the marking device 80. Rather than moving the housing 60, as in the adjustment component 84, the second adjustment component 86 moves the feeder 50 laterally, relative to an adjacent transport member 100 (or vice versa) in the direction of arrow A. This has the effect of shifting sheets 24 laterally to a new position on transport 100. The second adjustment component 86 may include a threaded lead screw 144, which is received in a threaded bore 146 in a bracket 148, which is fixedly attached to a side 150 (or 152) of the feeder 50 that is aligned with the process direction. Alternatively, the threaded bore 146 may be formed in the side 150 or 152 of feeder 50. Two or more lead screws 144, arranged in parallel, may be used in place of the single lead screw shown. The lead screw may be spaced vertically and/or horizontally from each other. Each lead screw 144 may be driven laterally by a second reversible drive motor 154, which is controlled automatically by the adjustment controller 134 (or by a different adjustment controller). When the sheet feeder 50 is moved laterally by the second adjustment component 86, sheets exit the feeder at a position on the adjacent transport member 100 which is shifted laterally, relative to the marking device 80, in a similar manner to that illustrated in FIGS. 2 and 3, but at a location upstream. In this embodiment, the housing 60 does not need to move across the floor during the lateral adjustment. Where the print media supply module 14 includes more than one feeder 50, 52, a second adjustment component 86 may be provided for each feeder. Alternatively, a single second adjustment component 86 may move both feeders contemporaneously. This would allow the docking position to adjust relative to feeder, moving the feeder paper input inboard to outboard.

In another embodiment, the second adjustment component 86 includes a lead screw mechanism, similar to mechanism 86, attached to a docking bullet that mounts the respective feeder 50, 52 to the housing/frame 64 of the image rendering module.

In another embodiment, the print media supply module 14 includes a set of trays 158, 160, which each hold a respective stack 54, 56, of sheets 24. The second adjustment component 86 may attach each tray separately to the feeder, e.g., through a lead screw mechanism as described above, which provides for relative lateral motion between the tray 158 or 160 and the feeder. This embodiment enables the lateral adjustment of a specific feed of sheets rather than the feeder output in its entirety.

The first and second adjustment components 84, 86 serve the same function and may be used in combination or only one of the two may be used.

As illustrated in FIG. 9, the sheet transport path adjustment mechanism 26 may alternatively or additionally include a third adjustment component 88, which enables one or more of adjacent transports 162, 164 of the duplex path 76 to be moved, relative to the other. In the illustrated embodiment, transport 162 may include a conveyor belt, a plate, a combination thereof, or the like on which the sheet 24 is transported. The third adjustment component 88 moves the transport 162 so that sheets exit the transport 162 onto transport 164 in a different, laterally spaced position. In the illustrated embodiment, transport 162 is pivotable at a first end 166 on a pivot pin 168. A second end 170 of the transport 162 is movable, laterally. The second end may be driven laterally by a lead screw 172.

Figure 10:
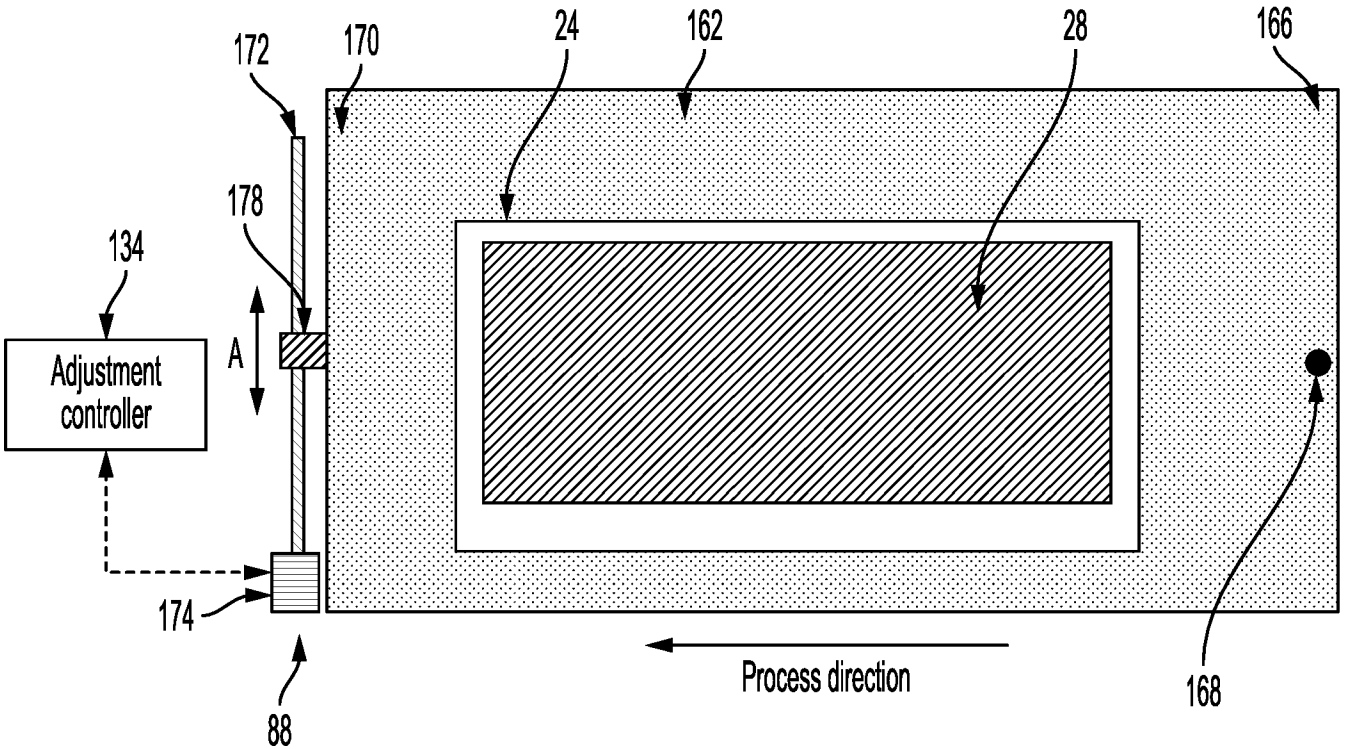
FIG. 10 is a top plan view of a third adjustment component of the system of FIG. 1.
Figure 11:
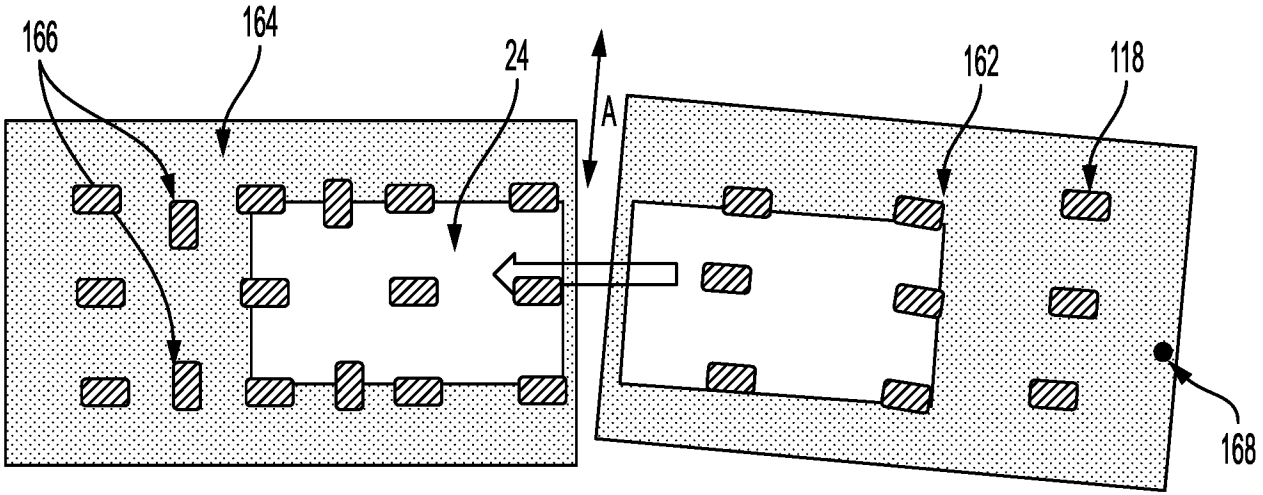
FIG. 11 is a top plan view of the third adjustment component of the system of FIG. 1, after relative movement of sheet transport members.

With reference also to FIG. 10, which shows a top plan view of the third adjustment component 88, the lead screw 172 may be driven by a reversible motor 174 which displaces the downstream end 170 of the transport in the direction of arrow A (cross-process direction). The opposite end 166 of the transport pivots on the pivot pin 168 of the transport 162. The transport 162 may include a flange 178, which extends outwardly in the process direction. The flange has a threaded bore to receive the lead screw therethrough. After the transport 162 has been shifted by the lead screw, a sheet 24 passing downstream on the transport 162 will enter the subsequent transport 164 at a position which is shifted laterally in the direction of arrow A, as illustrated in FIG. 11 in top plan view (exaggerated for ease of illustration). The reversible drive motor 174 may be controlled automatically by the adjustment controller 134 (or by a different adjustment controller).

The transports 162, 164 may be configured similarly to transports 100, 102, 110.

The third adjustment component 88 may alternatively or additionally include rollers (FIG. 11) which are configured to translate each sheet laterally, in the cross process direction. The rollers may be positioned above and below the sheet, to create a nip. The rollers may have an axis of rotation in the process direction. Such rollers may be alternatively or additionally be controlled to reduce skew in the sheets. Examples of other rollers are described, for example, in U.S. Pub. Nos. 20150284203 and 20190300314.

As an alternative to, or in addition to, a lead screw, the adjustment component 84, 86, and/or 88 providing the lateral shift of one portion of the transport path relative to another may additionally, or alternatively, include other known mechanisms that can provide controlled physical motion. For example, other electric, electromechanical, pneumatic, or hydraulic devices are contemplated. Such devices may include one or more, or combinations, of electric motors, belts, chains, pulleys, gears, pneumatic cylinders or motors, hydraulic cylinders or motors, and other known devices.

As shown in FIG. 9, the sheet registration device 104 may be located downstream of the return path inlet slot 105 and also downstream of the scanner 107, where present. Since the adjustment mechanism 26 is able to correct for large scale errors in the positioning of the sheets 24 on the transports, the sheet registration device 104 is able to handle the smaller registration errors, such as skew and lateral and process direction shift of individual sheets 24, and the images printed thereon, more efficiently. The smaller corrections that the sheet registration device 104 is required to perform, allow the sheet processing system 10 to operate at higher print speeds and/or be used for larger sheets 24, which tend to be more likely to skew.

The sheet registration device 104 may include a set of sensors 190, which detect the position of the sheet as it passes over them. The sensors may be arranged in rows to detect one or more edges of the sheet. Associated sheet registration devices 192, such as paper aligning spheres or rollers, forced air nozzles, combinations thereof, or the like, create steering nips which move the sheet relative to the paper path to correct registration errors (e.g., skew and/or lateral position errors). In some embodiments, the sheet registration devices 192 may also serve as sheet conveying members 118.

Any suitable registration system may be employed as device 104. Examples are described in U.S. Pat. Nos. 4,179,117, 5,065,998, 10,589,950, 10,569,981, and U.S. Pub. No. 20150284203, incorporated herein by reference.

As shown in FIG. 9, the marking device 80 may include a marking component 194, such as a laser (xerographic) or inkjet marking component, which applies an image to the sheet using a marking material, such as inks or tone particles, and a dryer or other fixing component 196, which affixes the image more permanently to the sheet, e.g., using one or more of heat, pressure or radiation, e.g., UV radiation.

In one embodiment, the marking device 80 is an inkjet marking device, which applies one or more liquid inks to the sheets 24 using a set of inkjet heads. The liquid inks may be water-based inks, which are dried (fixed) to the sheet with heat by a dryer 196, downstream of the inkjet heads. Alternatively, or additionally, the inks may include a radiation curable material, which is cured (fixed) with radiation, such as UV, by a UV curing station 196, downstream of the inkjet heads.

In another embodiment, the marking device 80 is an electrophotographic (laser) marking device, which applies one or more colored toners to the sheets 24 using a photoreceptor in the form of a belt or drum. The toners may be in the form of particles, which are fixed to the sheet with heat and/or pressure, e.g., by a dryer 196, downstream of the photoreceptor 194.

Other types of marking device 80, and/or a combination of marking devices, are also contemplated.

Figure 12:
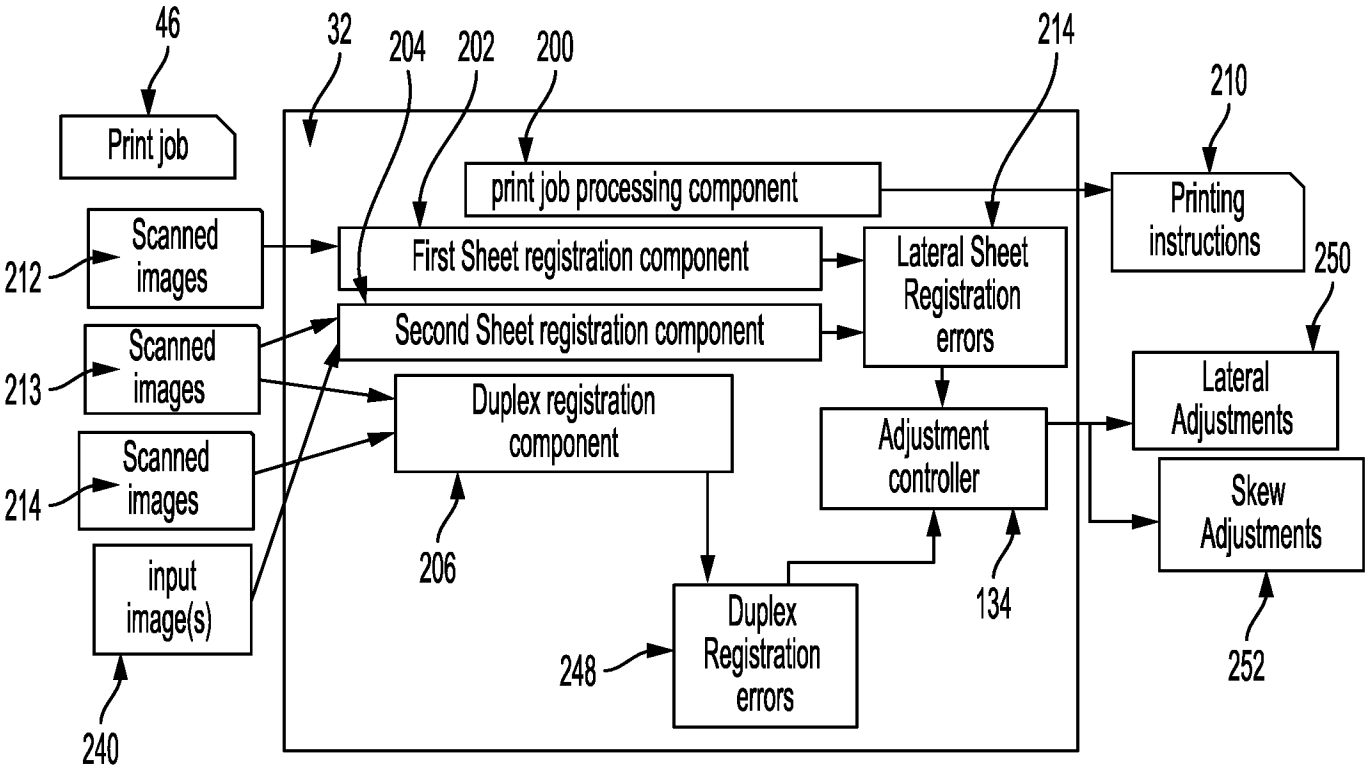
FIG. 12 is a functional block diagram of part of a control module of the system of FIG. 1.

With reference to FIG. 12, the instructions 32 may include an adjustment controller 134, a print job processing component 200, and one or more of a first (lateral) sheet registration component 202, a second (lateral) sheet registration component 204, and a duplex registration component 206.

The print job processing component 200 receives the print job 46 in digital form and provides instructions 210 to the image rendering module 16, for printing images 28, 29 on the sheets 24. The instructions include instructions for rendering each page of the print job by forming image(s) 28, 29 on one or more sheets 24 of print media.

Figure 13:
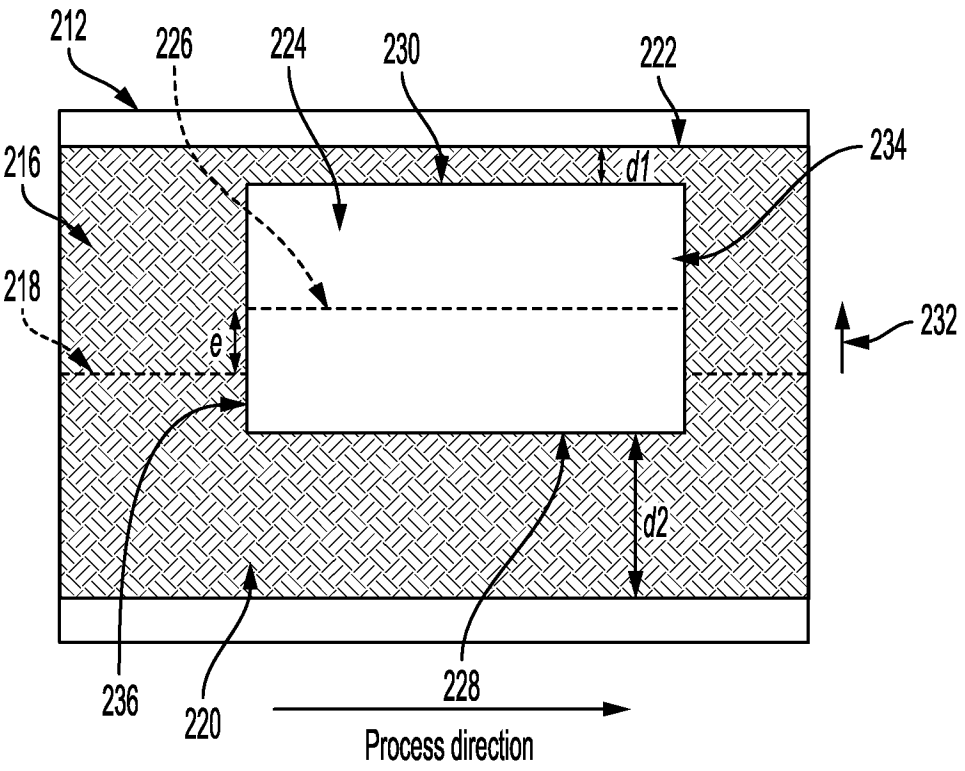
FIG. 13 illustrates an image acquired by a sensor system of the system of FIG. 1, upstream of a marking device.

The first sheet registration component 202 receives scanned images 212 from the scanner 107, and computes lateral sheet registration errors 215 for the corresponding sheets that have been scanned (e.g., as an average over several sheets). For example, as illustrated in FIG. 13, a scanned image 212 captured by the first scanner 107 may include a portion 216 of the transport 102, which has a center axis 218. Axis 218 may appear in the image 212 or be computed, e.g., based on locations of inboard and/or outboard edges 220, 222 of the transport in the image. The image 212 also includes a representation 224 of at least a portion of side 1 of the sheet 24. A center axis 226 of the sheet representation 224 may be computed based on positions of inboard and outboard edges 228, 230 of the sheet representation 224 (halfway between them). The lateral sheet error e may be computed as the (average lateral shift, of the sheet center line 226, relative to the center line 218 of the transport member, e.g., ±a determined number of mm. In this case, a lateral adjustment 232 of the transport path to correct the error may be e. As will be appreciated, a lateral sheet error e could alternatively be computed as a function of a difference d between distances d1 and d2, where d1 is the average distance between edges 222 and 230 and d2 is the average distance between edges 220 and 228.

The first lateral sheet registration component 202 (or a separate component) may also be used to compute skew in the sheets. For example, if d1 and/or d2 are determined to differ between a forward edge 234 and a trailing edge 236 of the sheet representation 224, an angle of skew can be computed from the difference.

The scanned images 212 may be captured in color or monochrome. Monochrome is generally sufficient as the sheets are often white or otherwise have a different grayscale value to the transport member. The sheets arriving from the feeder have no image printed thereon and the sheets arriving from the duplex path 76 have no image printed on the uppermost side (side 2). Accordingly, the first lateral sheet registration component 202 does not rely on locations of images on the sheets.

The second lateral registration component 204 receives scanned images 213 from the second scanner 108. The second lateral registration component 204 may compute lateral errors and/or skew in a similar manner to the first lateral registration component 202, i.e., by computing at the lateral position of a sheet representation 224 on the transport 110.

In one embodiment, scanned images 212 and 213 captured by the first and second scanners 107, 108 may be compared to determine a lateral drift of the sheet 24 as it passes through the marking device 80. The lateral drift can be used as the duplex registration error 248 for computing lateral adjustments 250 to be implemented by one or more of the adjustment components, such as the third adjustment component 88.

Figure 14:
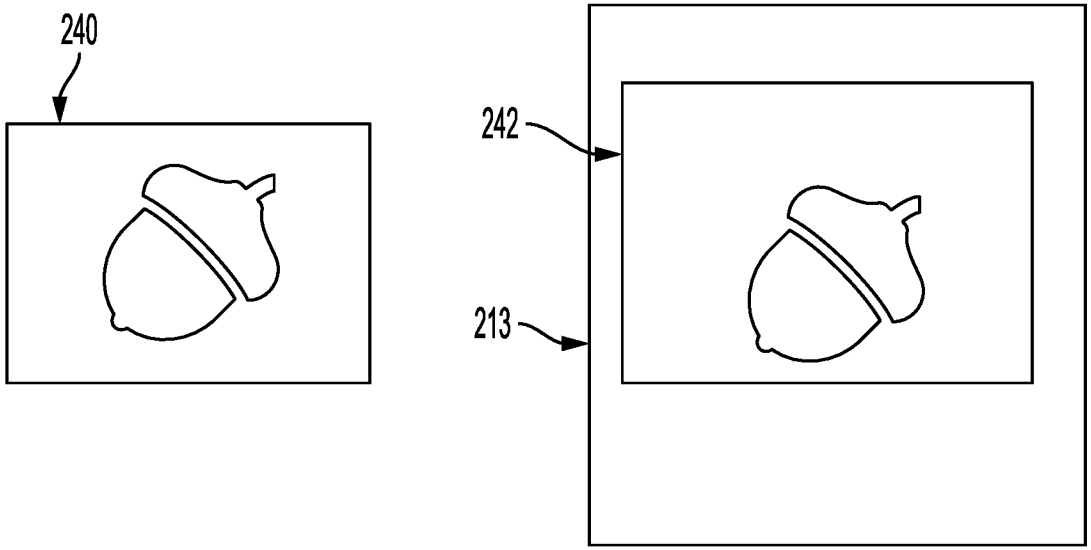
FIG. 14 illustrates another image acquired by the sensor system of the system of FIG. 1, downstream of a marking device.

In another embodiment, illustrated in FIG. 14, the second lateral registration component 204 computes an alignment between an input digital image 240 and a target image 242 in the scanned image 213. The target image 242 is the result of a rendering of the digital image 240 on a sheet 24 and may be offset on the sheet, skewed, and or differ in size from the input digital image 240. In the alignment process, corners of the target image 242 may first be aligned with corresponding corners of the input image 240. Then, locations of local features within the target and input images are compared to determine a lateral shift e. Skew may also be computed. The input digital image 240 may be a customer image, e.g., part of the print job 46. Alternatively, the input image 240 may be a calibration image with a predefined arrangement of markings. U.S. application Ser. No. 16/988,183, incorporated by reference, provides one suitable method for aligning the images 240, 242 and identifying features from which the lateral sheet registration errors 215 may be computed.

Once the lateral sheet registration errors 215 are computed by one or more of the sheet registration components 202, 204, the adjustment controller 134 computes lateral adjustments 250 to be implemented by one or more of the adjustment components 84, 86, 88. The lateral adjustments 250 are predicted to reduce the lateral errors in registration of the sheet on the paper path, when implemented by one or more of the adjustment component(s) 84, 86, 88. The adjustment controller 134 controls the adjustment component(s) 84, 86, 88 to implement the computed lateral adjustments 250.

In addition to computing lateral sheet registration errors 215, one or both of the sheet registration components 202, 204, may compute other errors, such as skew of the sheets. In some cases, these may be used by the adjustment controller 134 to compute skew adjustments 252 for one or more of the adjustment components 84, 86, 88 which mechanically move one portion of the transport path angularly, relative to another, thereby shifting sheets angularly (i.e., at an angle to the process and cross-process directions) on the transport path. In other embodiments, the sheet registration device 104 may be employed to implement the skew adjustments 252. In some embodiments, the sheet registration components 202, 204, may be combined into a single component, which first determines the lateral adjustments 232, and then, once these have been implemented, computes fine-grained adjustments for implementation by the registration device 104. The fine-grained adjustments can be computed and implemented on the fly, e.g., while printing a set of sheets, registration errors computed for one sheet can be applied by the registration device before printing a subsequent sheet.

In one embodiment, the optional duplex registration component 206 determines duplex registration errors 248 between back and front sides of the same printed sheet using scanned images 213, 214 of the printed front and back sides of the sheet acquired by the same scanner 108 or by different scanners 108, 109. The adjustment controller 134 may then determine lateral adjustments 250 to be implemented by one or more of the adjustment components 84, 86, 88, which are expected to improve the alignment between front and back side images 28, 29.

In another embodiment, scanned images 213, 214 of the printed front and back sides of the sheet acquired by the same scanner 108 or by different scanners 108, 109 are used to modify digital images to be printed or make adjustments to the marking device 80 to reduce alignment errors between first and second side images 28, 29 that are subsequently printed.

The lateral adjustments 250 and/or skew adjustments 252 may be implemented during set up of the sheet processing system 10. For example, once the image rendering module has been installed, one or more of the adjustment components 84, 86, 88 may be actuated, based on computed adjustments 250 and/or 252. Subsequent adjustments may be made, for example, when a new type of paper is installed in the print media supply module 14, or on demand by a user.

In some embodiments, adjustments may be made automatically, without user input. In other embodiments, the user interface 42 may be employed to provide the user with an opportunity to provide input, e.g., through a user input device, such as a touch screen 256 and/or keypad 258 (FIG. 1). The user may be provided with a graphical user interface (GUI) for selecting one or more of: a time when the adjustments 250, 252 should be computed and/or made, whether a proposed adjustment should be made, to be shown a simulated view of the adjustment, e.g., a display of the effect of the adjustment on an image or images on a printed sheet, or the like.

The control module 12 of the exemplary system 10 may include one or more computing devices, such as a PC, such as a desktop, a laptop, palmtop computer, portable digital assistant (PDA), server computer, cellular telephone, tablet computer, pager, combination thereof, or other computing device capable of executing instructions for performing the exemplary method.

The memory 30 may represent any type of non-transitory computer readable medium such as random access memory (RAM), read only memory (ROM), magnetic disk or tape, optical disk, flash memory, or holographic memory. In one embodiment, the memory 30 comprises a combination of random access memory and read only memory. In some embodiments, the processor 34 and memory 30 may be combined in a single chip. Memory 30 stores instructions for performing the exemplary method as well as the processed data.

The network interface 36, 38 allows the control module 12 to communicate with other devices via a computer network, such as a local area network (LAN) or wide area network (WAN), or the internet, and may comprise a modulator/demodulator (MODEM) a router, a cable, and/or Ethernet port.

The digital processor device 34 can be variously embodied, such as by a single-core processor, a dual-core processor (or more generally by a multiple-core processor), a digital processor and cooperating math coprocessor, a digital controller, or the like. The digital processor 34, in addition to executing instructions 32 may also control the operation of the control module 12.

The term "software," or "instructions" as used herein, is intended to encompass any collection or set of instructions executable by a computer or other digital system so as to configure the computer or other digital system to perform the task that is the intent of the software. The term "software" as used herein is intended to encompass such instructions stored in storage medium such as RAM, a hard disk, optical disk, or the like, and is also intended to encompass so-called "firmware" that is software stored on a ROM or the like. Such software may be organized in various ways, and may include software components organized as libraries, Internet-based programs stored on a remote server or so forth, source code, interpretive code, object code, directly executable code, and so forth. It is contemplated that the software may invoke system-level code or calls to other software residing on a server or other location to perform certain functions.

Figure 15A:
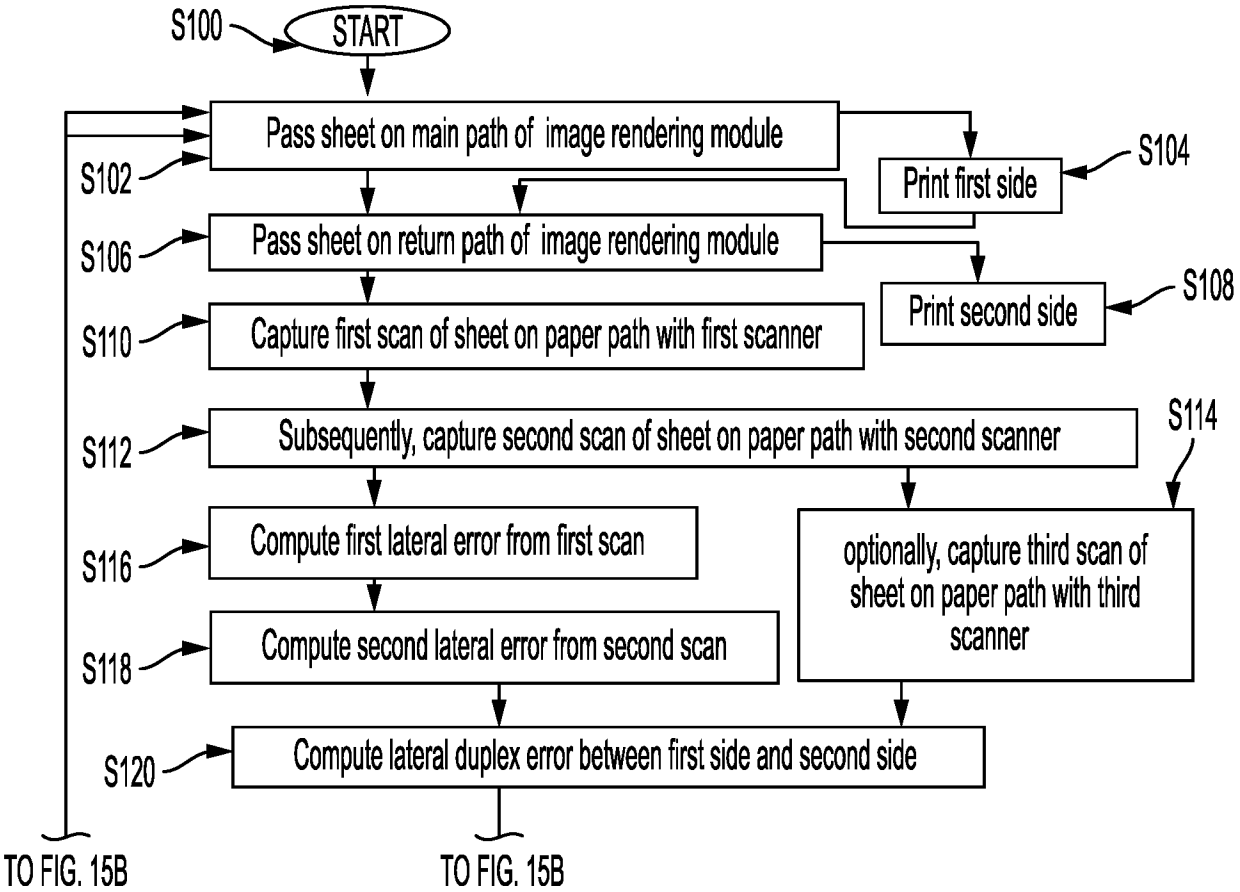
FIG. 15, which is split into FIGS. 15A and 15B for ease of illustration, is a flow chart of a method for sheet adjustment in accordance with another aspect of the exemplary embodiment.
Figure 15B:
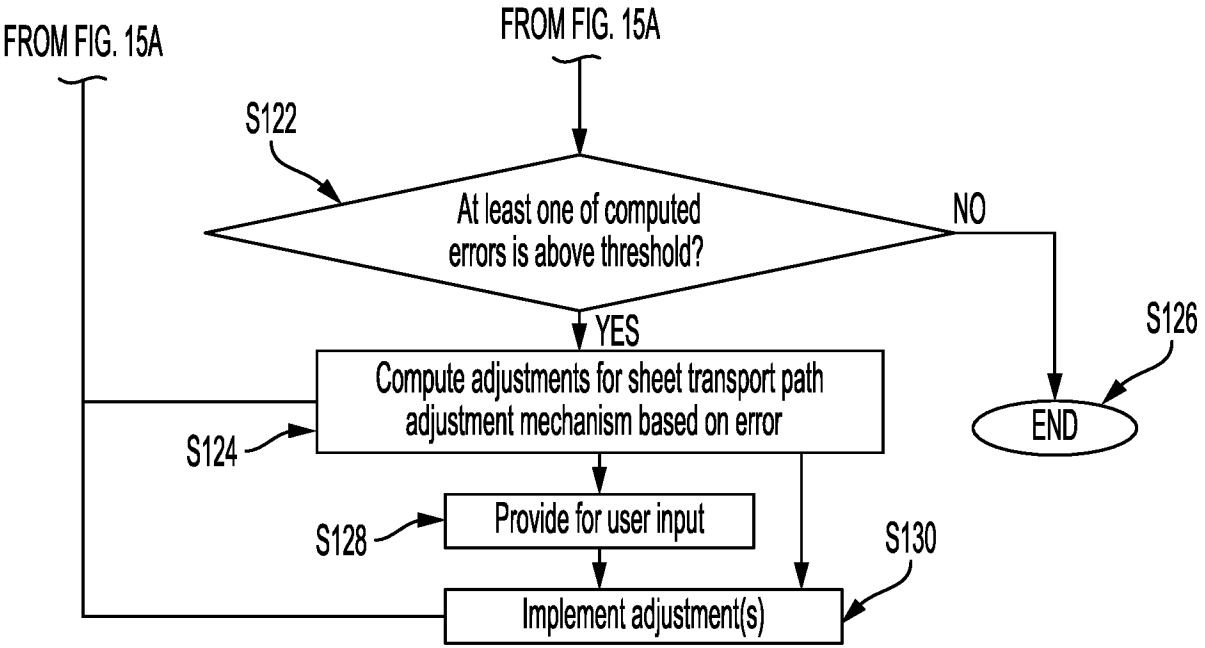

With reference to FIG. 15, which is split into FIGS. 15A and 15B for ease of illustration, a method for automated sheet adjustment is illustrated. The method begins at S100.

At S102, a blank sheet 24 is passed from the feeder along the main path 72 of an image rendering module 16.

At S104, a first side of the sheet may be printed with a first image by the marking device 80. The first image may be generated from an original (customer) image or a calibration image.

At S106, in the case of duplex printing, the optionally marked sheet is passed from the making device 80 onto the duplex path 76 of the image rendering module.

At S108, a second side of the sheet may be printed with a second image by the marking device. The second image may be generated from an original (customer) image or a test image.

At S110, a first scanned image 212 of the first side of the sheet may be captured, e.g., with the first scanner 107. The scanned first image 212 may include all or a significant portion of the first side of the sheet and optionally include at least a portion of the transport on which the first side of the sheet is positioned during capture as illustrated in FIG. 13. As will be appreciated, S110 is generally performed prior to S106.

At S112, a second scanned image of the sheet 24 may be captured after the sheet has passed through the marking device 80. The second scanned image may be captured with the sensor system 25 by one of the scanners 107, 108, 109. In one embodiment, the second scanned image of the sheet 24 is captured by the scanner 107, after the sheet has been printed and returned to the main path via the duplex path. In another embodiment, the second scanned image 213 of the sheet may be captured with the second scanner 108, after the sheet has been passed through the marking engine (with or without printing). In another embodiment, the second scanned image 214 of the sheet may be captured with the third scanner 108, after the sheet has been passed through the marking engine (with or without printing).

Optionally, at S114, a third scanned image 214 of the sheet 24 may be captured with the sensor system 25 after the sheet has passed through the marking device 80, with a different one of the scanners 107, 108, 109 from that used to capture the second scanned image. For example, were the second scanned image is captured with scanner 108, the third scanned image may be captured with scanner 109.

At S116, a first lateral error 232 is computed for a first side of the sheet, based on the first scanned image 212 of the first side of the sheet.

Optionally, at S118, a second lateral error 232 is computed for the first or second side of the sheet, based on the second scanned image.

Optionally, at S120, a duplex registration error 248 is computed between the first and second sides of the sheet, based on differences between the first scanned image 212 and/or 213 of the first side of the sheet and the corresponding scanned image 213 or 214 of the second side of the sheet.

If at S122, at least one of the errors computed at S116, S118, and S120 exceeds a predefined threshold error, then at S124, one or more adjustments is computed for one or more of the adjustment components 84, 86, 88. Otherwise, the method may proceed to S126, or return, at a later time, to S102.

Optionally, at S128, a user may be provided with an opportunity to implement the adjustment at that time or at a later time.

At S130, the appropriate adjustment components are called on to implement the adjustments.

The method may return from S130 to S102 for a second iteration. A second set of lateral errors is computed at S116, S118, and/or S120 to determine if the adjustments made at S130 in the first iteration have corrected the errors. The iterations may continue until the errors are below the threshold or until some stopping point is reached (e.g., no further improvement and/or a set number of iterations have been completed).

The method ends at S126.

The method illustrated in FIG. 15 may be implemented in a computer program product that may be executed on a computer. The computer program product may comprise a non-transitory computer-readable recording medium on which a control program is recorded (stored), such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other non-transitory medium from which a computer can read and use. The computer program product may be integral with the computer 30 (for example, an internal hard drive of RAM), or may be separate (for example, an external hard drive operatively connected with the computer 30), or may be separate and accessed via a digital data network such as a local area network (LAN) or the Internet (for example, as a redundant array of inexpensive or independent disks (RAID) or other network server storage that is indirectly accessed by the control module 12, via a digital network).

Alternatively, the method may be implemented in transitory media, such as a transmittable carrier wave in which the control program is embodied as a data signal using transmission media, such as acoustic or light waves, such as those generated during radio wave and infrared data communications, and the like.

The exemplary method may be implemented on one or more general purpose computers, special purpose computer (s), a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA, Graphics card CPU (GPU), or PAL, or the like. In general, any device, capable of implementing a finite state machine that is in turn capable of implementing the flowchart shown in FIG. 15, can be used to implement the method. As will be appreciated, while the steps of the method may all be computer implemented, in some embodiments one or more of the steps may be at least partially performed manually. As will also be appreciated, the steps of the method need not all proceed in the order illustrated and fewer, more, or different steps may be performed.

The exemplary system and method may have several advantages. In the case of side 1 adjustments, the conventional process of undocking and redocking of the feeder for each iteration after checking the input lateral position using a sheet registration tool can be avoided. The adjustments can be performed automatically by the first and/or second adjustment components 84, 86, under the control of the adjustment controller 134. While the adjustments may be performed in several iterations, the time taken is generally much less than for manually moving the feeder 50 and/or entire print supply module 14. The adjustments needed can be computed with a high degree of accuracy, rather than relying primarily on guesswork.

Similarly, in the case of side 2 adjustments, rather than manually skewing the duplex horizontal transports (adjustments on the input and output sides of the transport that allow skewing of transport clockwise or counter-clockwise, which in turn walks the paper inboard or outboard), the adjustment process can be automated, reducing the time taken and/or the accuracy achieved.

The scanned images 213 captured by the second scanner 108 and/or third scanner 109 can also be used for performing image on paper (IOP) registration. For example, registration errors such as lateral shift, magnification, and/or skew of the image representation 242, relative to the input image 240 may be used to transform the input image 240, to generate a transformed input image for printing, so that the sheet with the printed image 28, 29 thereon more accurately resembles the input image 240, as described, for example, in U.S. application Ser. No. 16/988,183. The same downstream scanner 108 can thus be used in the process for paper path adjustments as well as in the process for IOP registration.

It may be noted that the shrink rate of a sheet is based upon the ink coverage and on the thickness of the sheet. This makes it difficult to use a look up table method to account for paper shrinkage. With the aid of the FWA scanner(s), the sheet scan pre-drying (side 1 pass) can be compared to the post-drying, input side 2 scan of the sheet to compute a shrinkage of that sheet in the process and cross process directions.

Installation of a full width array sensor 107 on the entrance side of the paper path (before sheet registration device 104) can allow the lateral errors to be at least partially addressed before the sheet registration device 104, allows for a less stressful registration of the sheets which improves the output variation. This also allows for higher sheet speeds and a higher output of sheets per minute.

An overarching learning algorithm can be implemented to allow system learning of optimal values of the various adjustment parameters, such as a look up table or function for computing an adjustment for one or more of the adjustment components, given a computed lateral error.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A sheet processing system for automated sheet adjustment comprising:

a sensor system which captures at least a first image of a sheet of print media as the sheet is conveyed on a main transport path between a print media supply module and a marking device of an image rendering module;

a control module which computes a lateral error for the sheet, based on the captured at least first image, and computes an adjustment based on the computed lateral error;

a print media supply module which includes a sheet feeder configured to feed sheets to a first portion of a main transport path, the sheet feeder and the first portion of the main transport path being mounted to a first housing, which is supported on rolling members;

an image rendering module which includes a second housing and a second portion of the main transport path; and a sheet transport path adjustment mechanism which shifts the first housing relative to the second housing to translate the first portion of the main transport path relative to the second portion of the main transport path, based on the computed adjustment.

2. The sheet processing system of claim 1, wherein the sensor system comprises a first full width array scanner, which is positioned to capture a first image of the sheet on the main transport path upstream of the marking engine.

3. The sheet processing system of claim 1, wherein the sheet transport path adjustment mechanism includes a third adjustment component which translates a first portion of a duplex transport path relative to a second portion of the duplex transport path, a first end of the duplex transport path being connected to the main transport path downstream of the marking device and a second end of the duplex transport path being connected to the main transport path upstream of the marking device.

4. The sheet processing system of claim 3, wherein the third adjustment component translates the first portion of the duplex transport path based on the adjustment for the computed drift.

5. The sheet processing system of claim 1, wherein the sensor system comprises second and third full width array scanners, which are positioned downstream of marking device, a first of the second and third full width array scanners facing a first side of the sheet and a second of the second and third full width array scanners facing a second side of the sheet.

6. A sheet processing system for automated sheet adjustment comprising:

a sensor system which captures at least a first image of a sheet of print media as the sheet is conveyed on a main transport path between a print media supply module and a marking device of an image rendering module;

a control module which computes a lateral error for the sheet, based on the captured at least first image, and computes an adjustment based on the computed lateral error; and a sheet transport path adjustment mechanism which translates a first portion of the main transport path relative to a second portion of the main transport path, based on the computed adjustment, the sheet transport path adjustment mechanism including a first adjustment component which translates a first housing of the media supply module relative to a second housing of the image rendering module to translate the first portion of the main transport path, which is in the first housing, relative to the second portion of the main transport path, which is in the second housing, the first adjustment component comprising a first bracket which links the first housing to the second housing, the first bracket being movable laterally, relative to one of the first and second housings.

7. The sheet processing system of claim 6, wherein the first bracket is driven laterally by a lead screw.

8. The sheet processing system of claim 6, wherein the first bracket includes an attachment portion which is attached to one of the first housing and the second housing, and at least one flange, extending from the attachment portion, which carries a bar therethrough, the bar extending from the other of the first housing and the second housing.

9. A sheet processing system for automated sheet adjustment comprising:

a sensor system which captures at least a first image of a sheet of print media as the sheet is conveyed on a main transport path between a print media supply module and a marking device of an image rendering module;

a control module which computes a lateral error for the sheet, based on the captured at least first image, and computes an adjustment based on the computed lateral error; and a sheet transport path adjustment mechanism which includes:

a first adjustment component which translates a first portion of the main transport path relative to a second portion of the main transport path, based on the computed adjustment; and a second adjustment component which translates a sheet feeder in the print media supply module relative to one of:

a portion of the main transport path downstream of the feeder; and a tray in the print media supply module which holds a stack of sheets.

10. A sheet processing system comprising:

a sensor system which captures at least a first image of a sheet of print media as the sheet is conveyed on a main transport path between a print media supply module and a marking device of an image rendering module, the sensor system comprising:

a first full width array scanner, which is positioned to capture a first image of the sheet on the main transport path upstream of the marking engine, and a second full width array scanner, which is positioned to capture a second image of the sheet on the main transport path downstream of the marking engine;

a control module which computes a lateral error for the sheet, based on the captured at least first image, and computes an adjustment based on the computed lateral error; and a sheet transport path adjustment mechanism which translates a first portion of the main transport path relative to a second portion of the main transport path, based on the computed adjustment.

11. The sheet processing system of claim 10, wherein the control module computes a drift in the lateral error for the sheet, based on the captured first and second images, and computes an adjustment based on the computed drift in the lateral error.

12. A sheet processing method comprising:

receiving a captured first image of a sheet of print media as the sheet is conveyed on a main transport path between a print media supply module and a marking device of an image rendering module, the print media supply module including a first housing, the image rendering module including a second housing;

computing a lateral error for the sheet, based on the captured first image;

computing an adjustment based on the computed lateral error when the lateral error exceeds a threshold; and providing instructions for translating a first portion of the main transport path relative to a second portion of the main transport path, with a first automated adjustment component, based on the computed adjustment, wherein the translating comprises driving a first bracket which links the first housing to the second housing, the first bracket being movable laterally, relative to one of the first and second housings.

13. The sheet processing method of claim 12, wherein the computing of the lateral error, computing the adjustment, and providing instructions are performed with a processor.

14. The method of claim 12, further comprising:

receiving a captured second image of the sheet of print media as the sheet is conveyed on the main transport path downstream of the marking device;

computing a second lateral error for the sheet, based on the captured second image;

computing a second adjustment based on the computed second lateral error when the second lateral error exceeds a threshold; and providing instructions for translating a first portion of a duplex transport path relative to a second portion of the duplex transport path with a second automated adjustment component, based on the computed adjustment, the duplex transport path configured for returning sheets to the main transport path.

15. The method of claim 12, wherein the method includes, for a second sheet:

repeating the receiving of a captured first image, computing a lateral error for the sheet, computing an adjustment based on the computed lateral error when the lateral error exceeds the threshold; and providing instructions for translating the first portion of the main transport path relative to the second portion of the main transport path, with the first automated adjustment component, based on the computed adjustment.

16. A computer program product comprising a non-transitory recording medium storing instructions, which when executed on a computer, causes the computer to perform the method of claim 12.

17. A sheet adjustment system comprising:

memory which stores instructions for:

receiving at least a first image of a sheet of print media captured as the sheet is conveyed on a main transport path between a print media supply module and a marking device of an associated image rendering module, the main transport path receiving print media from a plurality of sheet feeders, each of the sheet feeders configured to feed sheets singly from a respective stack;

computing a lateral error for the sheet, based on the captured at least first image;

determining whether the lateral error exceeds a threshold;

computing an adjustment based on the computed lateral error when the lateral error exceeds the threshold; and providing the computed adjustment to an associated sheet transport path adjustment mechanism configured for automatically translating a first portion of the main transport path relative to a second portion of the main transport path, based on the computed adjustment; and a processor which executes the instructions.

* * * * *